US010274249B2

(12) United States Patent
Wang

(10) Patent No.: US 10,274,249 B2
(45) Date of Patent: Apr. 30, 2019

(54) REFRIGERATOR

(71) Applicants: Hefei Hualing Co., Ltd., Hefei, Anhui (CN); Hefei Midea Refrigerator Co., Ltd., Hefei, Anhui (CN)

(72) Inventor: Junze Wang, Anhui (CN)

(73) Assignees: HEFEI HUALING CO., LTD., Hefei, Anhui (CN); HEFEI MIDEA REFRIGERATOR CO., LTD., Hefei, Anhui (CN)

( * ) Notice: Subject to any disclaimer, the term of this patent is extended or adjusted under 35 U.S.C. 154(b) by 0 days.

(21) Appl. No.: 15/508,637

(22) PCT Filed: Sep. 24, 2014

(86) PCT No.: PCT/CN2014/087259
§ 371 (c)(1),
(2) Date: Mar. 3, 2017

(87) PCT Pub. No.: WO2016/033846
PCT Pub. Date: Mar. 10, 2016

(65) Prior Publication Data

US 2017/0299253 A1 Oct. 19, 2017

(30) Foreign Application Priority Data

Sep. 5, 2014 (CN) ..... 2014 1 0453303
Sep. 5, 2014 (CN) ..... 2014 2 0512031 U

(51) Int. Cl.
*F25D 23/06* (2006.01)
*F25D 23/02* (2006.01)
(Continued)

(52) U.S. Cl.
CPC ..... *F25D 23/069* (2013.01); *F25D 11/02* (2013.01); *F25D 23/02* (2013.01); *F25D 23/066* (2013.01);
(Continued)

(58) Field of Classification Search
CPC ..... F25D 11/02; F25D 23/02; F25D 23/066; F25D 23/069; F25D 23/087
(Continued)

(56) References Cited

U.S. PATENT DOCUMENTS 2,540,940 A * 2/1951 Ganzer ..... F25D 11/04 220/23.83
5,174,640 A * 12/1992 Kuwahara ..... B29C 44/18 312/407
(Continued)

FOREIGN PATENT DOCUMENTS

CN 2407301 Y 11/2000
CN 201081513 Y 7/2008
(Continued)

OTHER PUBLICATIONS

English Translation of Written Opinion of the International Searching Authority dated Jun. 5, 2015 for corresponding International Application PCT/CN2014/087259, filed Sep. 24, 2014.
(Continued)

*Primary Examiner* — James O Hansen
(74) *Attorney, Agent, or Firm* — David D. Brush; Westman, Champlin & Koehler, P.A.

(57) ABSTRACT

A refrigerator is provided. The refrigerator includes: a cabinet having a cabinet liner; a partition plate assembly disposed in the cabinet liner and configured to partition an inner space of the cabinet liner into a plurality of compartments spaced apart from one another; and a door having a door liner, mounted to the cabinet, and configured to open or close the plurality of compartments simultaneously, in which the door liner is configured to be sealingly fitted with the partition plate assembly so as to isolate the plurality of compartments hermetically.

7 Claims, 7 Drawing Sheets

(51) Int. Cl.
*F25D 11/02* (2006.01)
*F25D 23/08* (2006.01)

(52) U.S. Cl.
CPC ..... *F25D 23/087* (2013.01); *F25D 2400/04* (2013.01); *F25D 2400/06* (2013.01)

(58) Field of Classification Search
USPC ..... 312/401, 404, 405, 406, 407, 408; 220/592.02, 592.03, 592.04
See application file for complete search history.

(56) References Cited

U.S. PATENT DOCUMENTS

| | | | | |
|---|---|---|---|---|
| 5,662,061 | A * | 9/1997 | Salathe | B63B 7/085 114/347 |
| 5,893,620 | A * | 4/1999 | Birgelis | F25D 23/067 312/334.44 |
| 6,131,760 | A * | 10/2000 | Huang | B65D 25/04 220/326 |
| 6,779,357 | B1 | 8/2004 | Fann | |
| 7,140,159 | B2 * | 11/2006 | Avendano | F25D 23/082 52/784.1 |
| 9,429,357 | B2 | 8/2016 | Cha et al. | |
| 9,970,703 | B2 | 5/2018 | Cha et al. | |
| 2004/0129707 | A1 * | 7/2004 | Weir | A47J 47/10 220/500 |
| 2004/0262319 | A1 | 12/2004 | Fisher | |
| 2005/0082956 | A1 * | 4/2005 | Leistner | B60N 3/104 312/408 |
| 2007/0169505 | A1 * | 7/2007 | Kim | F25D 11/022 62/441 |
| 2010/0199709 | A1 | 8/2010 | Holland et al. | |
| 2014/0015394 | A1 | 1/2014 | Cha et al. | |
| 2016/0102905 | A1 | 4/2016 | Cha et al. | |
| 2016/0252294 | A1 | 9/2016 | Cha et al. | |

FOREIGN PATENT DOCUMENTS

| | | | |
|---|---|---|---|
| CN | 203036959 | U | 7/2013 |
| EP | 1447633 | A2 | 8/2004 |
| EP | 2685183 | A2 | 1/2014 |
| JP | 2006046750 | A | 2/2006 |

OTHER PUBLICATIONS

Chinese Office Action and English Translation dated Oct. 19, 2015 for Chinese Application No. 201410453303.9.

International Search Report dated Apr. 21, 2015 for corresponding International Application No. PCT/CN2014/087259, filed Sep. 24, 2014.

Written Opinion of the International Searching Authority dated May 27, 2015 for corresponding International Application No. PCT/CN2014/087259, filed Sep. 24, 2014.

European Search Report, dated Mar. 7, 2018 for corresponding European Patent Application No. 14901151.2, filed Mar. 9, 2017.

* cited by examiner

REFRIGERATOR

CROSS REFERENCE TO RELATED APPLICATIONS

The present application is a U.S. National Phase application under 35 U.S.C. § 371 of International Patent Application No. PCT/CN2014/087259, filed on Sep. 24, 2014, which published as WO 2016/033846 A1, on Mar. 10, 2016, not in English, and which claims the benefit of prior Chinese Application Nos. 201410453303.9 and 201420512031.0, filed with the State Intellectual Property Office of P. R. China on Sep. 5, 2014. The entire contents of the before-mentioned patent applications are incorporated by reference in their entireties.

FIELD

The present disclosure is related to a field of home appliance, and particularly to a refrigerator.

BACKGROUND

For a multi-compartment refrigerator in the present market, a heat preservation solution mostly adopted by respective compartments is that a plurality of doors are provided and in one-to-one correspondence with the compartments, that is, one compartment corresponds to one door, which has a high material cost and a complicated assembling process.

SUMMARY

The present disclosure seeks to solve one of the technical problems above in the related art at least to some extent. Thus, a refrigerator is provided by embodiments of the present disclosure, which adopts one door to open or close a plurality of compartments simultaneously and may seal the plurality of compartments by the one door.

The refrigerator according to embodiments of the present disclosure includes: a cabinet having a cabinet liner; a partition plate assembly disposed in the cabinet liner and configured to partition an inner space of the cabinet liner into a plurality of compartments spaced apart from each other; and a door having a door liner, mounted to the cabinet, and configured to open or close the plurality of the compartments simultaneously, in which the door liner is configured to be sealingly fitted with the partition plate assembly so as to isolate the plurality of compartments hermetically.

With the refrigerator according to embodiments of the present disclosure, a single door may be fitted with the plurality of compartments, which simplifies a structure of the refrigerator, reduces difficulties in an assembling process of the refrigerator, and controls a cost of the refrigerator at least to some extent.

In addition, the refrigerator according to embodiments of the present disclosure may further have additional technical features as follows.

According to an embodiment of the present disclosure, a first sealing member is provided at a front surface of the partition plate assembly; and a second sealing member is provided at a rear surface of the door liner, and the first sealing member is configured to be fitted with the second sealing member. Thus, by disposing the sealing members to the front surface of the partition plate assembly and the rear surface of the door liner respectively, a cooling capacity exchange among respective compartments can be reduced, thus realizing an area temperature control of each compartment better.

According to an embodiment of the present disclosure, the first sealing member is one of a sealing groove and a sealing protrusion, and the second sealing member is the other one of the sealing groove and the sealing protrusion.

According to an embodiment of the present disclosure, the partition plate assembly includes a horizontal partition plate and a vertical partition plate. The horizontal partition plate is disposed in the cabinet liner horizontally, and the vertical partition plate is oriented vertically and disposed between the horizontal partition plate and a top wall of the cabinet liner.

According to an embodiment of the present disclosure, two groups of the first sealing members are provided, one group of the first sealing members are uniformly disposed on a front surface of the horizontal partition plate along a left and right direction, and the other group of the first sealing member are uniformly disposed on the vertical partition plate along a vertical direction; and two groups of the second sealing members are provided, and the two groups of the second sealing members are in one-to-one correspondence with the two groups of the first sealing members.

According to an embodiment of the present disclosure, the one group of the first sealing members have a same length as the horizontal partition plate, and the other group of the first sealing members have a same height as the vertical partition plate.

According to an embodiment of the present disclosure, the partition plate assembly has a thickness ranging from 40 mm to 60 mm. Thus, the cooling capacity exchange among the respective compartments can be reduced and the area temperature control of each compartment can be realized better.

According to an embodiment of the present disclosure, the door is further provided with a plurality of third sealing members, the plurality of third sealing members are in one-to-one correspondence with the plurality of compartments, and each third sealing member is configured to be sealingly fitted with a corresponding compartment.

According to an embodiment of the present disclosure, the third sealing member is configured to be a sealing boss having a frame shape, and the sealing boss is configured to be tightly fitted with a part of an inner peripheral wall of the corresponding compartment, in which the part of the inner peripheral wall of the corresponding compartment is located in front of a shelf inserting groove, and the shelf inserting groove is formed in a side wall of the corresponding compartment. Thus, with the third sealing member being sealingly fitted with the corresponding compartment, a relatively sealed space is formed, a heat exchange among the respective compartments is reduced, and the area temperature control of each compartment can be realized.

According to an embodiment of the present disclosure, the second sealing member and the third sealing member are integrally formed on a rear surface of the door respectively. Thus, a structure of the refrigerator is simplified, and the refrigerator is convenient to be processed, thereby improving a production efficiency of the refrigerator.

Additional aspects and advantages of embodiments of present disclosure will be given in part in the following descriptions, become apparent in part from the following descriptions, or be learned from the practice of the embodiments of the present disclosure.

BRIEF DESCRIPTION OF THE DRAWINGS

These and other aspects and advantages of embodiments of the present disclosure will become apparent and more readily appreciated from the following descriptions made with reference to the drawings, in which.

Figure 1:
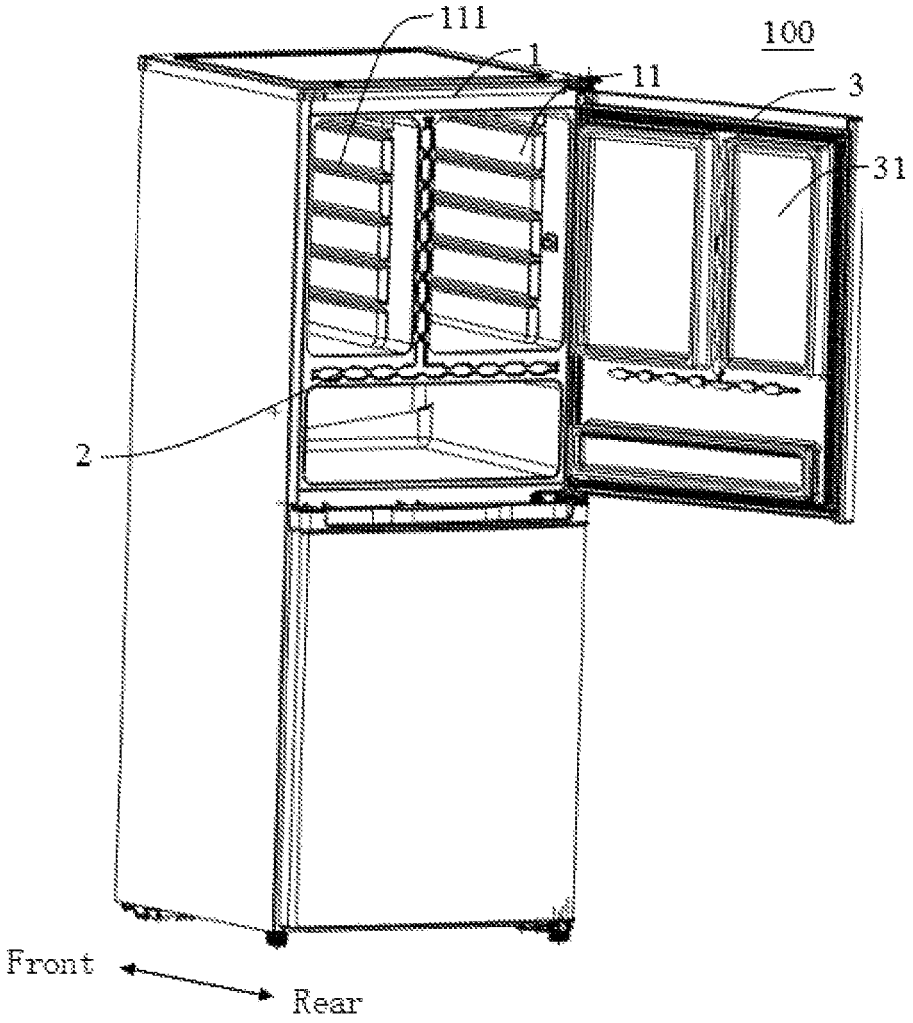
FIG. 1 is a schematic view of a refrigerator according to embodiments of the present disclosure.

REFERENCE NUMERALS refrigerator 100, cabinet 1, partition plate assembly 2, door 3, cabinet liner 11, compartment 101, shelf inserting groove 111, horizontal partition plate 21, vertical partition plate 22, first sealing member 211, door liner 31, second sealing member 311, third sealing member 312.

DETAILED DESCRIPTION

The embodiments of the present disclosure will be described in detail in the following. The same or similar elements and the elements having same or similar functions are denoted by like reference numerals throughout the descriptions. The embodiments described herein with reference to drawings are explanatory, illustrative, and used to generally understand the present disclosure and shall not be construed to limit the present disclosure.

In the specification, it is to be understood that terms such as "central," "longitudinal," "lateral," "length," "width," "thickness," "upper," "lower," "front," "rear," "left," "right," "vertical," "horizontal," "top," "bottom," "inner," "outer," "clockwise," "counterclockwise," "axial," "radial," and "circumferential," should be construed to refer to the orientation as then described or as shown in the drawings under discussion. These relative terms are for convenience of description and do not require that the present disclosure be constructed or operated in a particular orientation.

In addition, terms such as "first" and "second" are used herein for purposes of description and are not intended to indicate or imply relative importance or significance or to imply the number of indicated technical features. Thus, the feature defined with "first" and "second" may comprise one or more of this feature. In the description of the present disclosure, "a plurality of" means two or more than two, unless specified otherwise.

In the present disclosure, unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures; may also be inner communications of two elements or interaction relation of two elements, unless specified otherwise, which can be understood by those skilled in the art according to specific situations.

In the present disclosure, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed therebetween. Furthermore, a first feature "on," "above," or "on top of" a second feature may include an embodiment in which the first feature is right or obliquely "on," "above," or "on top of" the second feature, or just means that the first feature is at a height higher than that of the second feature; while a first feature "below," "under," or "on bottom of" a second feature may include an embodiment in which the first feature is right or obliquely "below," "under," or "on bottom of" the second feature, or just means that the first feature is at a height lower than that of the second feature.

A refrigerator 100 according to embodiments of the present disclosure will be described in detail in the following with reference to FIG. 1 to FIG. 7.

The refrigerator 100 according to embodiments of the present disclosure may include: a cabinet 1, a partition plate assembly 2 and a door 3.

As shown in FIG. 1, the cabinet 1 includes a shell and a cabinet liner 11, the cabinet liner 11 is disposed at an inner side of the shell, and a foam layer may be formed between the cabinet liner 11 and the shell via foaming process.

Figure 2:
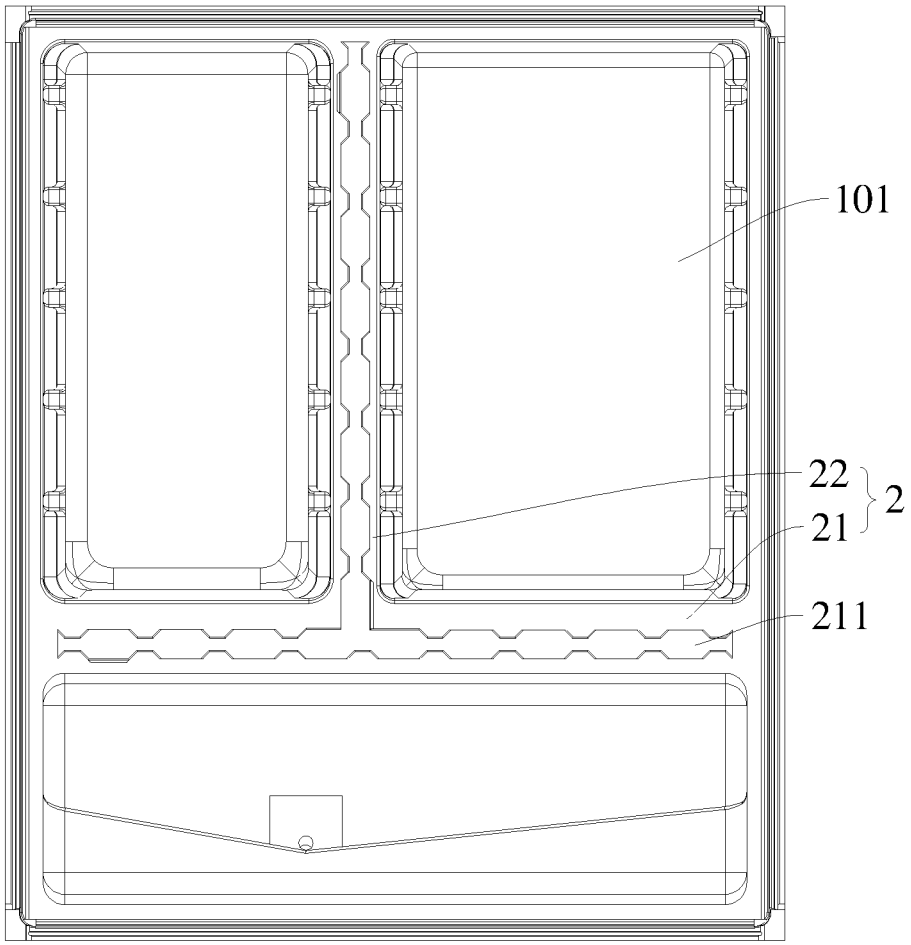
FIG. 2 is a schematic view of a cabinet liner and a partition plate assembly fitted with each other according to embodiments of the present disclosure, from a perspective.
Figure 3:
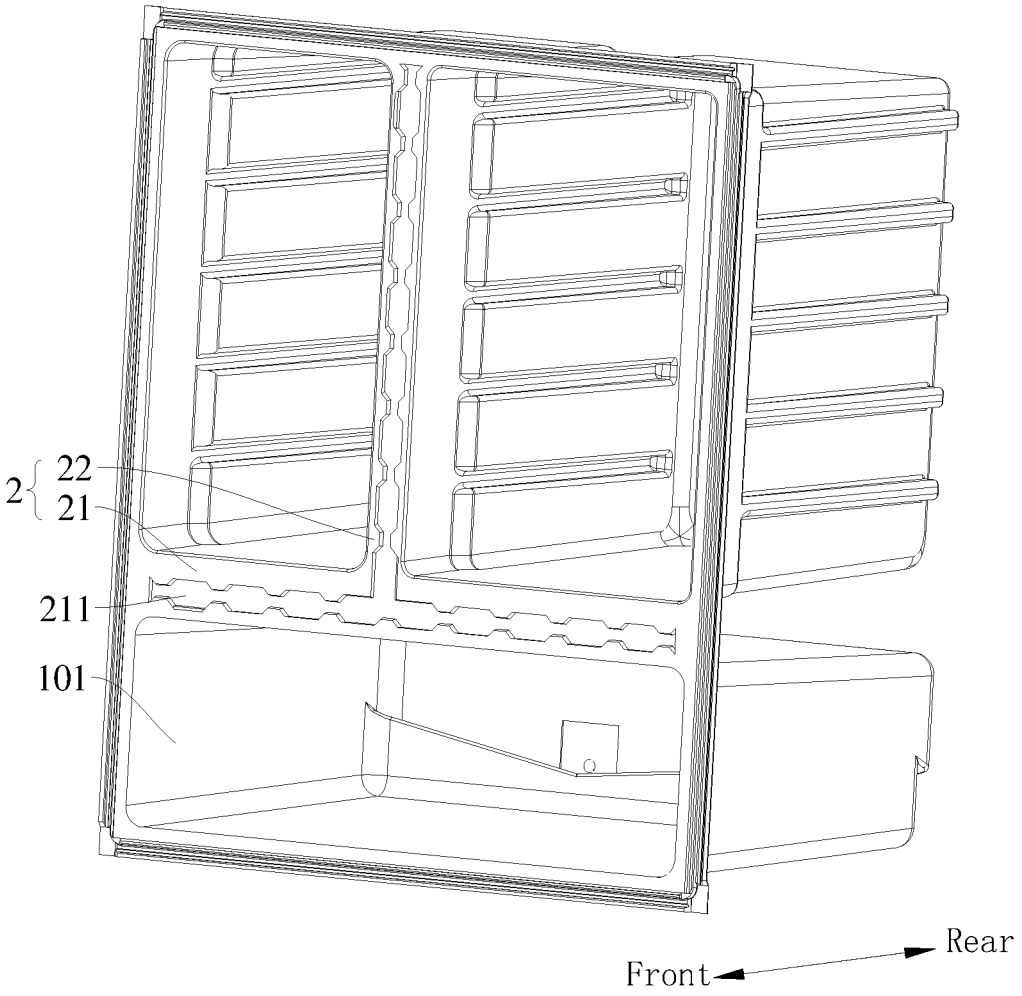
FIG. 3 is a schematic view of a cabinet liner and a partition plate assembly fitted with each other according to embodiments of the present disclosure, from another perspective.

As shown in FIG. 1 to FIG. 3, the partition plate assembly 2 is disposed within the cabinet liner 11, and the partition plate assembly 2 partitions an inner space of the cabinet liner 11 into a plurality of compartments 101 spaced apart from one another. In this example, the partition plate assembly 2 partitions the inner space of the cabinet liner 11 into three compartments 101 spaced apart from one another, but not limited to this.

Thus, a temperature of each compartment 101 may be controlled separately, so requirements of different food materials for temperatures can be satisfied.

The plurality of compartments 101 also allows a user to allocate a storage space more reasonably, which improves a space utilization of the cabinet liner 11 at least to some extent.

As shown in FIG. 1, the door 3 has a door liner 31, and the door 3 is mounted to the cabinet 1 and configured to open or close the plurality of compartments 101 simultaneously. In other words, different from a solution in the market that a plurality of the doors 3 are provided and correspond to the plurality of compartments 101, a single door 3 is adopted and configured to be fitted with the plurality of compartments 101 in the present disclosure.

Furthermore, the door liner of the door 3 is configured to be sealingly fitted with the partition plate assembly 2 so as to isolate the plurality of compartments hermetically. It should be noted that, "isolated hermetically" herein should be understood broadly, for example it may be understood as a meaning that cold air in respective compartments 101 will not circulate mutually under a function of a seal fit between the door liner 31 and the partition plate assembly 2.

With the refrigerator 100 according to embodiments of the present disclosure, the plurality of compartments 101 are sealed by means of one door 3. With respect to a structure in the related art that each compartment 101 corresponds to one sealing door 3, the refrigerator 100 according to embodiments of the present disclosure has a significantly simplified structure and an improved assembling efficiency, and also, a cost of the refrigerator 100 is controlled effectively.

Figure 4:
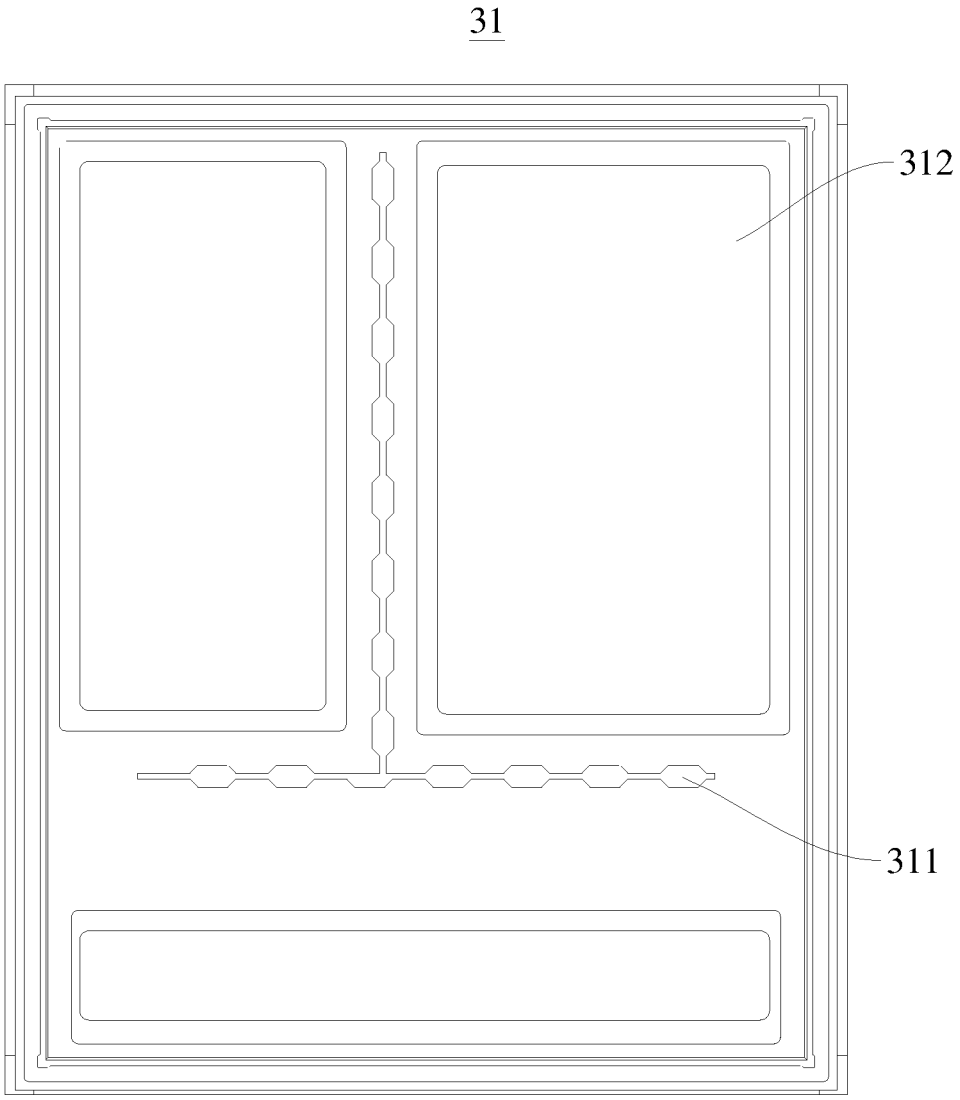
FIG. 4 is a schematic view of a door liner according to embodiments of the present disclosure, from a perspective.
Figure 5:
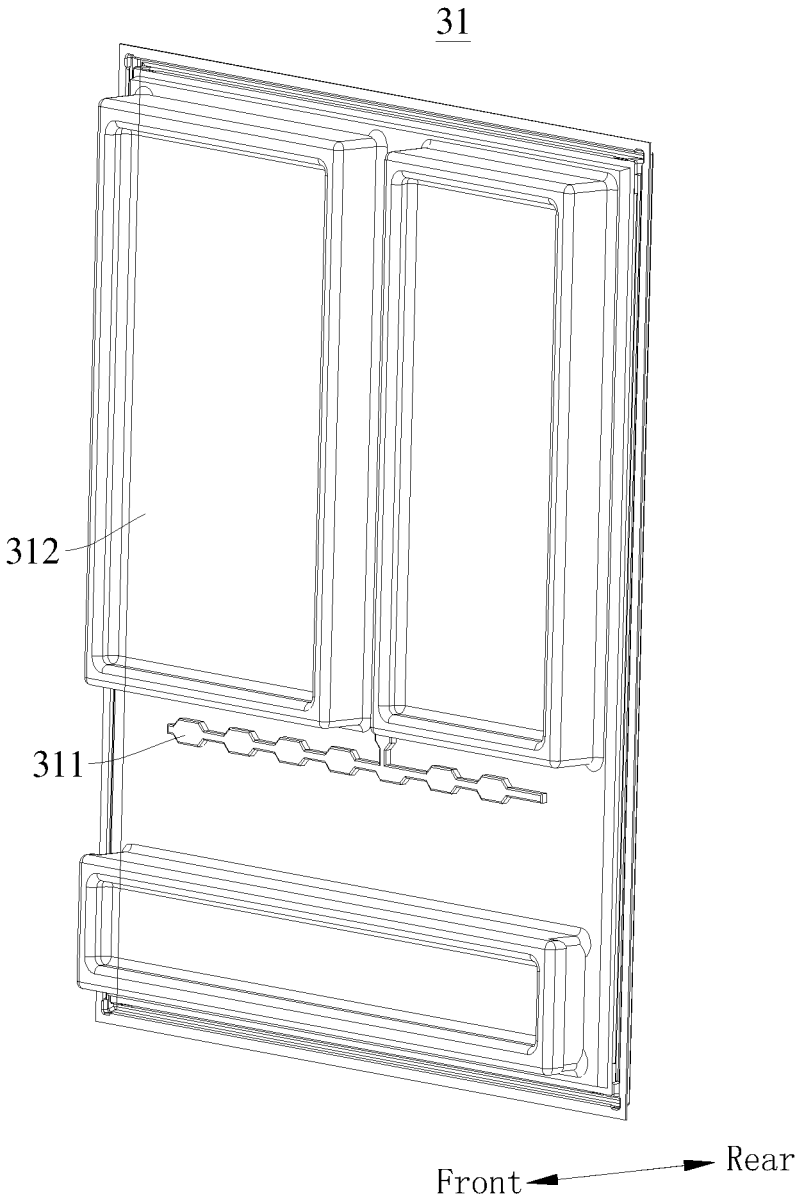
FIG. 5 is a schematic view of a door liner according to embodiments of the present disclosure, from another perspective.

In some embodiments of the present disclosure, as shown in FIG. 2 and FIG. 3, a first sealing member 211 is provided at a front surface of the partition plate assembly 2, and as shown in FIG. 4 and FIG. 5, a second sealing member 311 is provided at a rear surface of the door liner 31, in which the first sealing member 211 is configured to be fitted with the second sealing member 311.

Thus, by disposing the sealing members to the front surface of the partition plate assembly 2 and the rear surface of the door liner 31 respectively, a cooling capacity exchange among respective compartments 101 can be reduced, thus realizing an area temperature control of each compartment 101 better.

In some embodiments of the present disclosure, the first sealing member 211 is one of a sealing groove and a sealing protrusion, and the second sealing member 311 is the other one of the sealing groove and the sealing protrusion.

In other words, when the first sealing member 211 is the sealing groove, the second sealing member 311 is the sealing protrusion, and when the first sealing member 211 is the sealing protrusion, the second sealing member 311 is the sealing groove.

In this example, the first sealing member 211 is the sealing groove, and the second sealing member 311 is the sealing protrusion. The first sealing member 211 is configured to be tightly fitted with the second sealing member 311, and thus, by reducing the cooling capacity exchange among the respective compartments 101, the area temperature control of each compartment 101 can be realized better.

Figure 6:
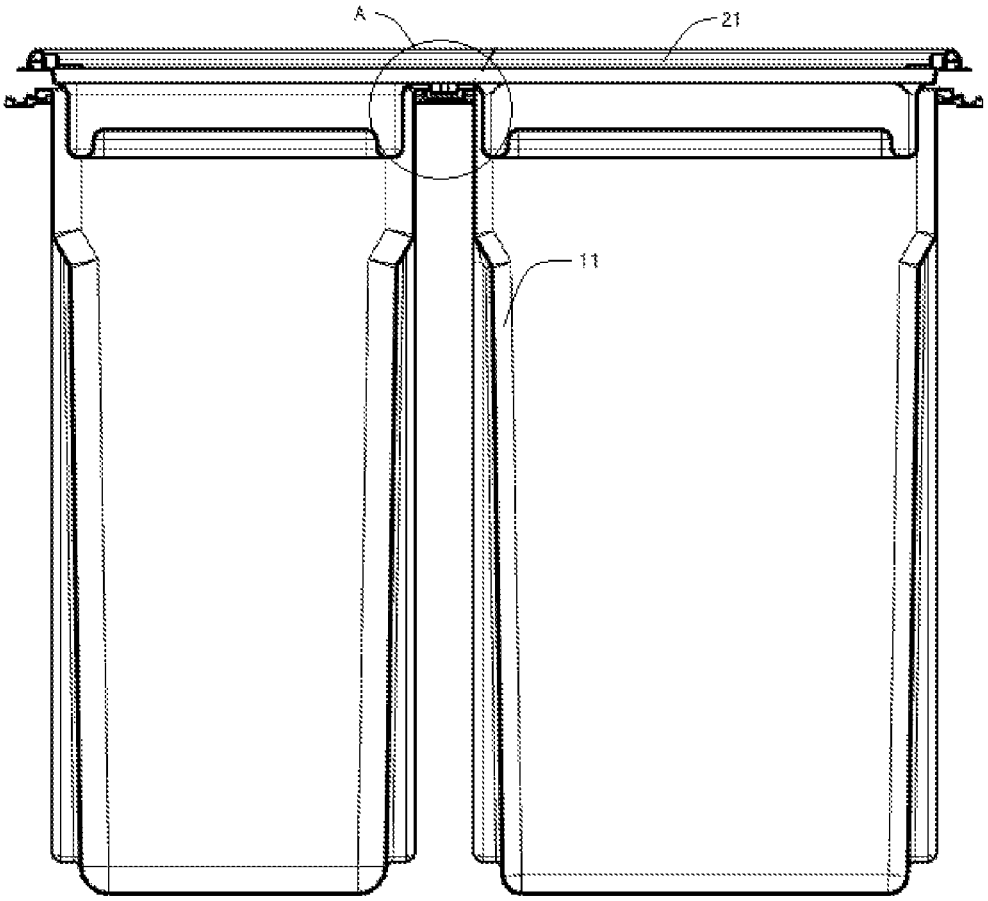
FIG. 6 is a schematic view of a door liner and a cabinet liner assembled together according to embodiments of the present disclosure.
Figure 7:
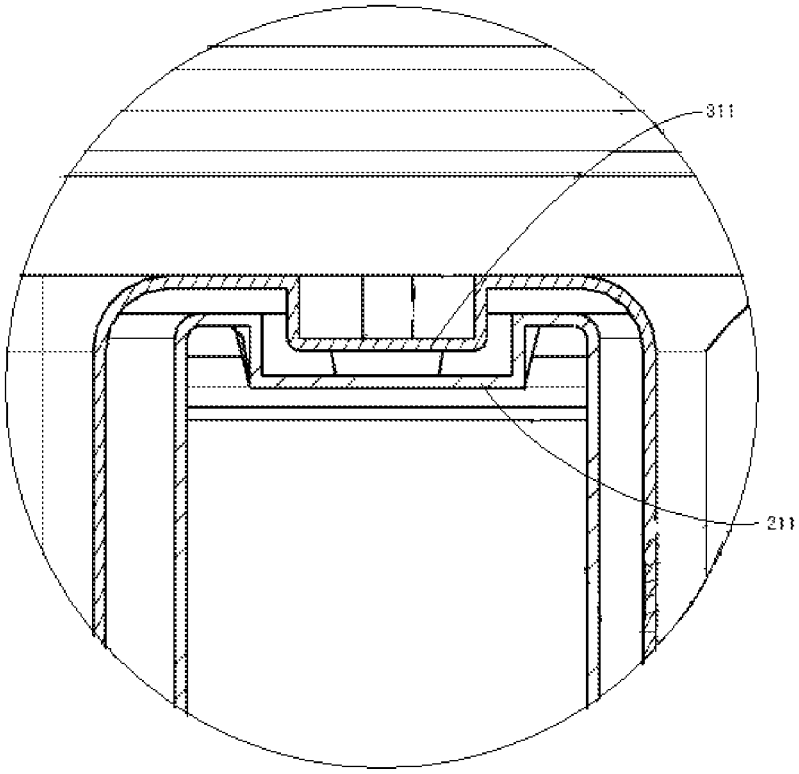
FIG. 7 is a partial enlarged view of part A circled in FIG. 6.

As shown in FIGS. 6 and 7, when the door 3 is closed, the partition plate assembly 2 is fitted with the door liner 31, and particularly the second sealing member 311 on the rear surface of the door liner 31 is fitted within the first sealing member 211 in the front surface of the partition plate assembly 2, so as to hermetically isolate the compartments 101 from one another.

In some embodiments of the present disclosure, as shown in FIG. 1 to FIG. 3, the partition plate assembly 2 includes a horizontal partition plate 21 and a vertical partition plate 22. The horizontal partition plate 21 is disposed in the cabinet liner 11 horizontally, and the vertical partition plate 22 is oriented vertically and disposed between the horizontal partition plate 21 and a top wall of the cabinet liner 11.

In other words, as shown in FIG. 1 to FIG. 3, the horizontal partition plate 21 and the vertical partition plate 22 divide the space in the cabinet liner 11 into three compartments 101 in different sizes.

In some embodiments of the present disclosure, as shown in FIG. 1 to FIG. 3, two groups of the first sealing members 211 are provided, in which one group of the first sealing members 211 are uniformly disposed on a front surface of the horizontal partition plate 21 along a left and right direction and have a same length (i.e. a total horizontal size in FIG. 2) as the horizontal partition plate 21, and the other group of the first sealing members 211 are uniformly disposed on the vertical partition plate 22 along a vertical direction and have a same height (i.e. a total vertical size in FIG. 2) as the vertical partition plate 22.

As shown in FIG. 4 and FIG. 5, two groups of the second sealing members 311 are provided and the two groups of the second sealing members 311 are in one-to-one correspondence with the two groups of the first sealing members 211.

That is, one group of the second sealing members 311 are uniformly disposed on the rear surface of the door liner 31 along the left and right direction and the other group of the second sealing members 311 are uniformly disposed on the rear surface of the door liner 31 along the vertical direction.

In some embodiments of the present disclosure, the partition plate assembly 2 has a thickness ranging from 40 mm to 60 mm. Thus, the cooling capacity exchange among the respective compartments 101 can be reduced and the area temperature control of each compartment 101 can be realized better.

Certainly, it should be understood that, the thickness of the partition plate assembly 2 in this example is just a preferable one, instead of a specific limitation to the thickness of the partition plate assembly 2 according to embodiments of the present disclosure.

In some examples of the present disclosure, the door 3 is further provided with a plurality of third sealing members 312, the plurality of third sealing members 312 are in one-to-one correspondence with the plurality of compartments 101, and each third sealing member 312 is configured to be sealingly fitted with a corresponding compartment 101.

As shown in FIG. 1 to FIG. 5, the door 3 is provided with three third sealing members 312, and the three third sealing members 312 correspond to the three compartments 101 one to one. When the door 3 is closed, the third sealing member 312 is sealingly fitted with the corresponding compartment 101, so that a relatively sealed space may be formed, and the heat exchange among the respective compartments 101 may be reduced, thereby realizing the area temperature control of each compartment 101.

In some embodiments of the present disclosure, as shown in FIG. 1, FIG. 4 and FIG. 5, the third sealing member 312 is configured to be a sealing boss having a frame shape, and the sealing boss is configured to be tightly fitted with a part of an inner peripheral wall of the corresponding compartment 101. The part of the inner peripheral wall of the corresponding compartment 101 is located in front of a shelf inserting groove 111, and the shelf inserting groove 111 is formed in a side wall of the corresponding compartment 101.

In this example, the third sealing members 312 in the form of boss are tightly fitted with the inner peripheral walls of the corresponding compartments 101 respectively, and the second sealing member 311 is disposed between the third sealing members 312 and fitted with the first sealing member 211. Thus, with the third sealing member 312 being sealingly fitted with the corresponding compartment 101, the relatively sealed space is formed, the heat exchange among the respective compartments is further reduced, and the area temperature control of each compartment 101 can be realized.

In some embodiments of the present disclosure, the second sealing member 311 and the third sealing member 312 may be integrally formed on a rear surface of the door 3 respectively. Thus, a structure of the refrigerator 100 is simplified, and the refrigerator 100 is convenient to be processed, thereby improving a production efficiency of the refrigerator 100.

Reference throughout this specification to "an embodiment," "some embodiments," "an example," "a specific example," or "some examples," means that a particular feature, structure, material, or characteristic described in connection with the embodiment or example is included in at least one embodiment or example of the present disclosure. Thus, the appearances of the phrases are not necessarily referring to the same embodiment or example of the present disclosure. Furthermore, the particular features, structures, materials, or characteristics may be combined in any suitable manner in one or more embodiments or examples. In addition, it will be apparent to those skilled in the art that different embodiments or examples described in this specification, as well as features of different embodiments or examples, may be combined or united without contradictory circumstances.

Although explanatory embodiments have been shown and described, it would be appreciated by those skilled in the art that the above embodiments cannot be construed to limit the present disclosure, and changes, alternatives, and modifications can be made in the embodiments without departing from spirit, principles and scope of the present disclosure.

What is claimed is:

1. A refrigerator, comprising:

a cabinet having a cabinet liner;

a partition plate assembly disposed in the cabinet liner and configured to partition an inner space of the cabinet liner into a plurality of compartments spaced apart from one another; and a door having a door liner, mounted to the cabinet, and configured to open or close the plurality of compartments simultaneously, wherein the door liner is configured to be sealingly fitted with the partition plate assembly so as to isolate the plurality of compartments hermetically, a temperature of each compartment is controlled separately, cold air in respective compartments is unable to circulate mutually under a function of a seal fit between the door liner and the partition plate assembly, wherein a first sealing member is provided at a front surface of the partition plate assembly; and a second sealing member is provided at a rear surface of the door liner, and the first sealing member is configured to be fitted with the second sealing member, wherein the door is further provided with a plurality of third sealing members, the plurality of third sealing members are in one-to-one correspondence with the plurality of compartments, and each third sealing member is configured to be sealingly fitted with a corresponding compartment, wherein each third sealing member is configured to be a sealing boss having a frame shape, and the sealing boss is configured to be tightly fitted with a part of an inner peripheral wall of the corresponding compartment, in which the part of the inner peripheral wall of the corresponding compartment is located in front of a shelf inserting groove, and the shelf inserting groove is formed in a side wall of the corresponding compartment.

2. The refrigerator according to claim 1, wherein the first sealing member is one of a sealing groove and a sealing protrusion, and the second sealing member is the other one of the sealing groove and the sealing protrusion.

3. The refrigerator according to claim 2, wherein the partition plate assembly comprises:

a horizontal partition plate disposed in the cabinet liner horizontally; and a vertical partition plate orientated vertically and disposed between the horizontal partition plate and a top wall of the cabinet liner.

4. The refrigerator according to claim 3, wherein two groups of the first sealing members are provided, one group of the first sealing members are uniformly disposed on a front surface of the horizontal partition plate along a left and right direction, and the other group of the first sealing members are uniformly disposed on the vertical partition plate along a vertical direction; and two groups of the second sealing members are provided, and the two groups of the second sealing members are in one-to-one correspondence with the two groups of the first sealing members.

5. The refrigerator according to claim 4, wherein the one group of the first sealing members has a same length as the horizontal partition plate, and the other group of the first sealing members has a same height as the vertical partition plate.

6. The refrigerator according to claim 1, wherein the partition plate assembly has a thickness ranging from 40 mm to 60 mm.

7. The refrigerator according to claim 1, wherein the second sealing member and the plurality of third sealing members are integrally formed on a rear surface of the door respectively.

* * * * *